United States Patent [19]

Holt

[11] 4,367,892

[45] Jan. 11, 1983

[54] LIFT SYSTEM FOR TILT-UP WALLS

[75] Inventor: Neil L. Holt, Foster City, Calif.

[73] Assignee: The Burke Company, San Mateo, Calif.

[21] Appl. No.: 199,944

[22] Filed: Oct. 23, 1980

[51] Int. Cl.[3] ..... B66C 1/36; B66C 1/66

[52] U.S. Cl. ..... 294/89; 52/125.5; 294/83 R

[58] Field of Search ..... 294/75, 82 R, 83 R, 294/84, 89, 78 R; 24/230.5 R, 232 R, 233, 235, 238–240, 241 R, 241 P, 241 SL; 52/125, 698–701; 59/85, 89, 93

[56] References Cited

U.S. PATENT DOCUMENTS 958,978 5/1910 Spencer ..... 294/83 R 3,883,170 5/1975 Fricker et al. ..... 294/89 X 4,173,367 11/1979 Haeussler ..... 294/89 X 4,173,856 11/1979 Fricker ..... 294/89 X

FOREIGN PATENT DOCUMENTS 2610195 9/1977 Fed. Rep. of Germany ..... 294/89

*Primary Examiner*—Johnny D. Cherry

*Attorney, Agent, or Firm*—Naylor, Neal & Uilkema

[57] ABSTRACT

A hoisting attachment for a tilt-up wall slab is provided with a remotely operable quick release mechanism which is under the control of the positional attitude of a hoisting cable-attached shackle. An improved assemblage of wall slab insert anchor, support stand for the insert anchor, and a recess former frictionally attached to the upper end of the anchor is also provided.

2 Claims, 12 Drawing Figures

LIFT SYSTEM FOR TILT-UP WALLS

BACKGROUND OF THE INVENTION

1. Field of the Invention

The field of this invention is hoisting attachments and methods for erecting tilt-up concrete walls. More specifically, the present invention relates to hoisting attachments of this type which are very safe to use and are quickly releasable. Also, the invention relates to improvements in anchor support members and recess formers which are used in the casting in place of recessed anchors for connection to such hoisting attachments.

2. Description of the Prior Art

The type of hoisting attachment with which the present invention is concerned is shown in U.S. Pat. No. 3,883,170. The hoisting attachment and hoisting method aspects of the present invention are concerned with improving the hoisting attachment and method of said patent for safe and efficient use with tilt-up walls.

SUMMARY OF THE INVENTION

A principal object of the invention is to provide a method for using a quick release hoisting attachment of the type described for tilt-up walls characterized by the fact that release of the attachment is not possible until the hoisting shackle part of the attachment is lowered out of its normal upright position.

A further object of the invention is to provide improved support means for the casting in place of the recessed anchor element.

A further object of the invention is to provide a new and improved recess forming device for use in forming the access recess to the wall anchor.

Other objects and advantages of the invention will be apparent from the following description taken in conjunction with the drawings forming part of this specification.

DESCRIPTION OF THE PREFERRED EMBODIMENT

Figure 1:
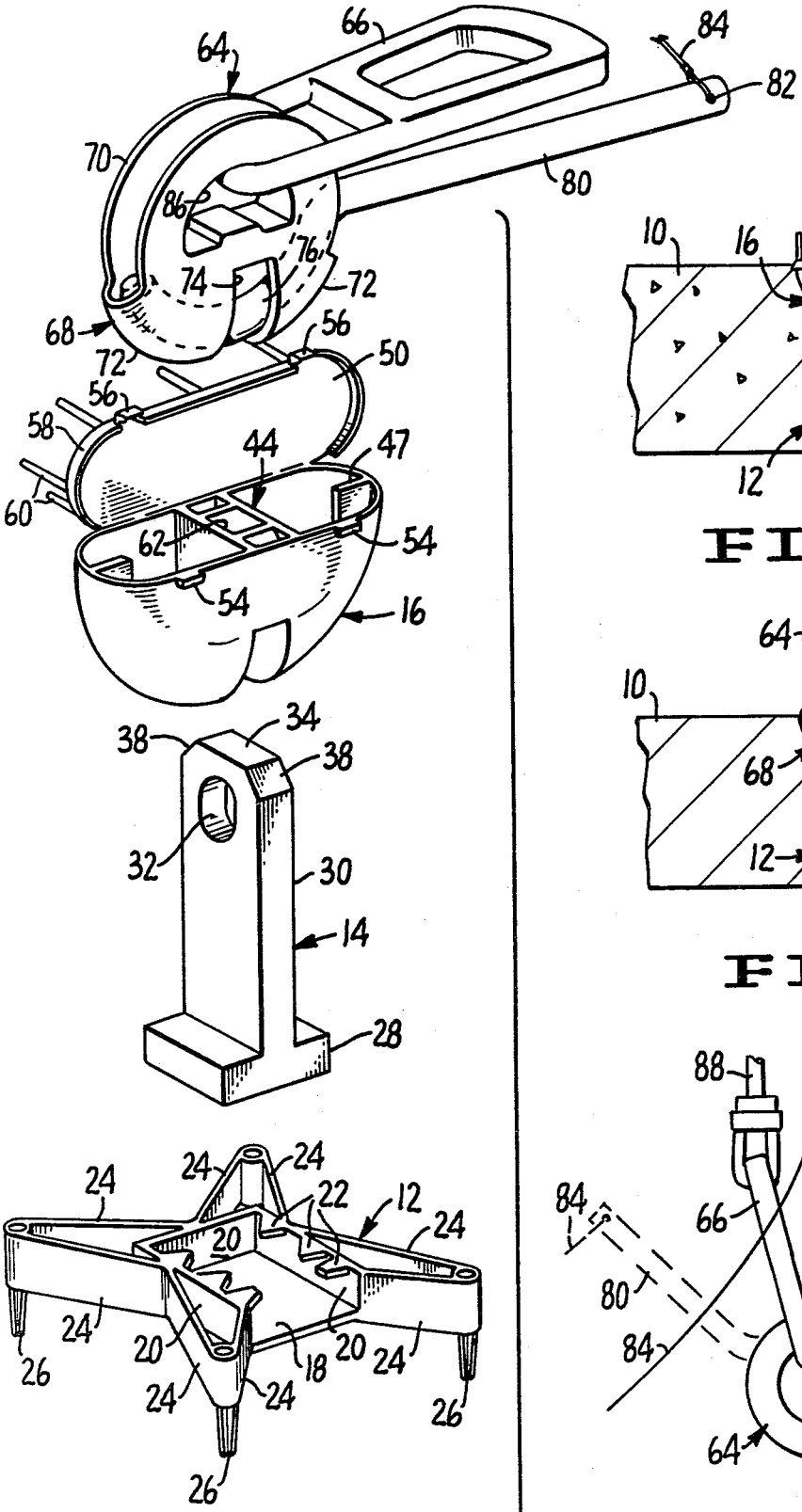
FIG. 1 is an exploded view in perspective showing the anchor support, recess forming and hoisting attachment equipment of the invention.
Figure 2:
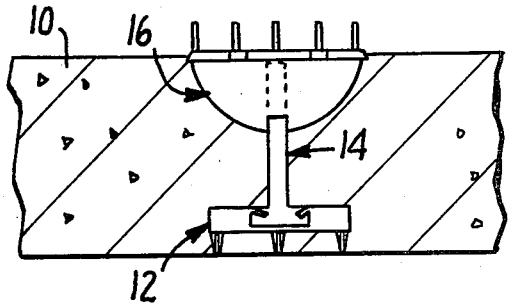
FIG. 2 is a view showing the anchor installation equipment in place within a cast tilt-up wall.

With reference to the drawings, a tilt-up concrete wall 10, which is typically cast at the job site in a horizontal, ground-supported form, not shown, is cast around an anchor support member 12, anchor 14 and recess former 16.

The anchor support 12 is made of plastic and comprises a central platform 18, a three-sided enclosure wall 20 around the platform, downwardly slanted, flexible tabs 22 extending partially over the platform 18, support and reinforcement webs 24, and foot elements 26 at the outer extremities of the webs 24 and centrally beneath platform 18.

Anchor 14 is preferably a one piece steel casting. It is provided with a rectangular base 28 and an upright stem 30 having aperture 32 and an upper end surface comprised of a horizontal surface 34 and converging outer surfaces 38.

Figure 6:
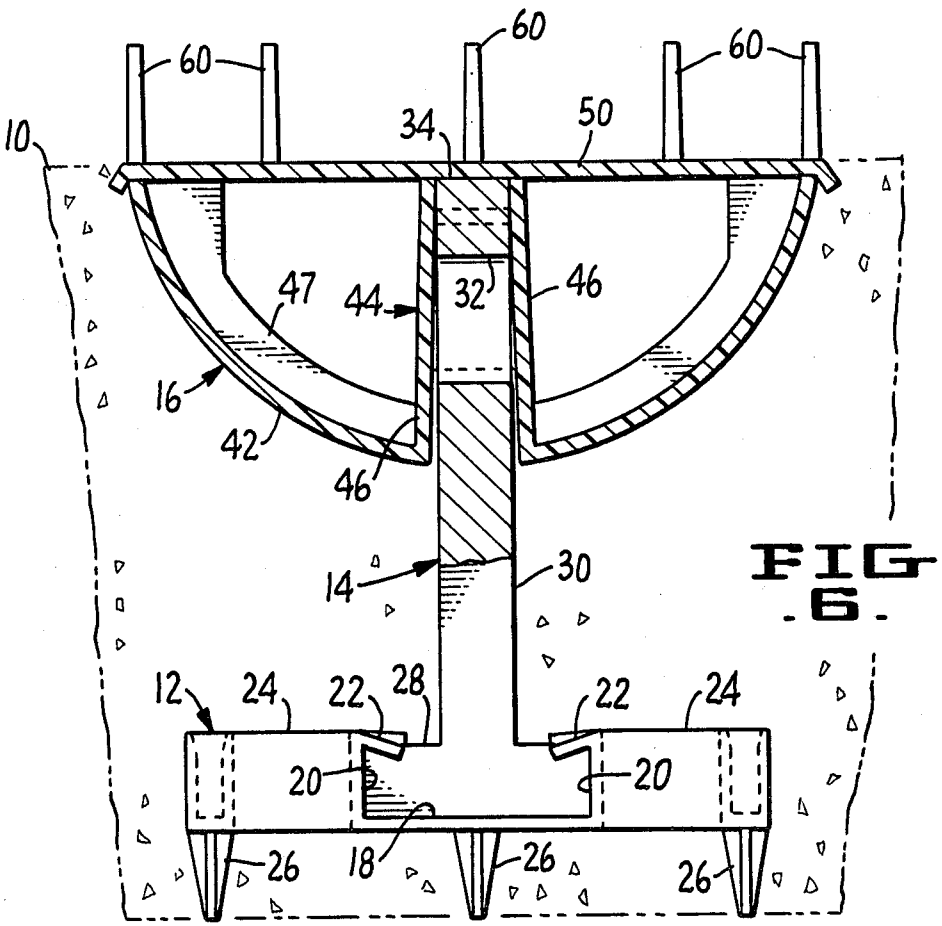
FIG. 6 is another view in section showing the anchor support, anchor and recess former, and showing in dotted outline the hoisting attachment.
Figure 5:
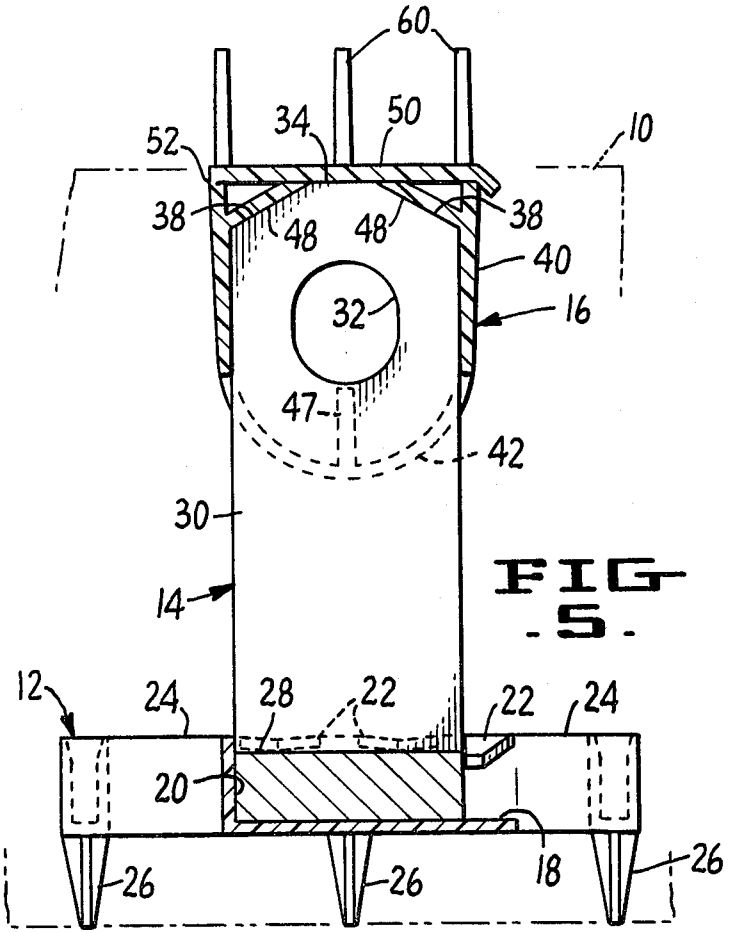
FIG. 5 is an enlarged view in section of the anchor support and recess former in attached relation to the anchor.
Figure 7:
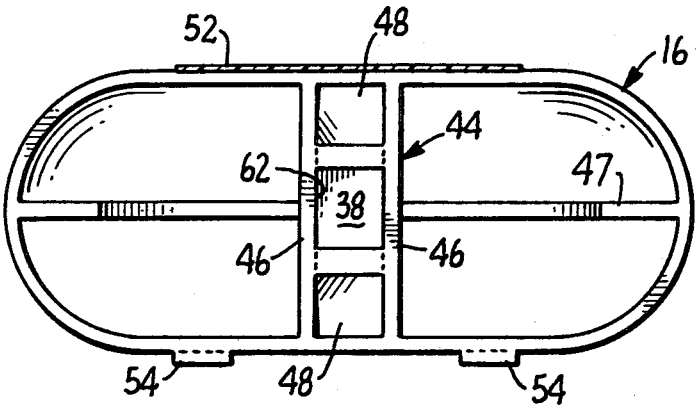
FIG. 7 is a top plan view of the recess former in open condition.
Figure 9:
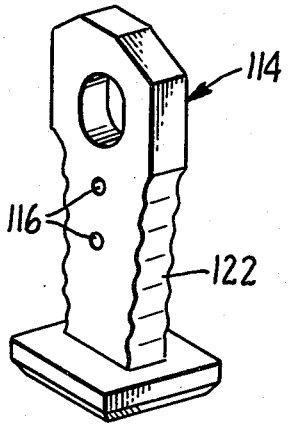
FIG. 9 is a view in perspective of an improved anchor.
Figure 8:
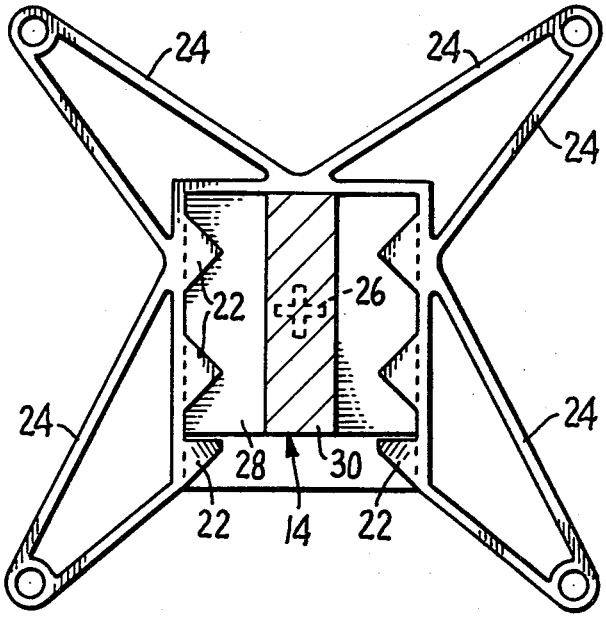
FIG. 8 is a top plan view of the anchor support and anchor.
Figure 10:
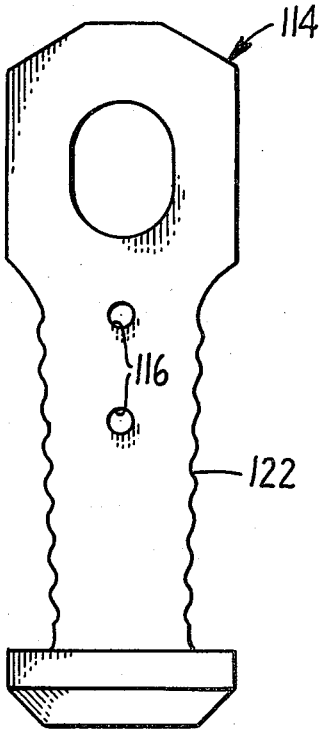
FIG. 10 is a view in front elevation of the anchor of FIG. 9.

The recess former 16 is provided with flat side walls 40, a circumferentially and transversely curved underside wall 42 (FIGS. 5 and 6), a receiving socket 44 defined by side walls 40, interior walls 46, and upper sloped walls 48, a top 50 pivotally connected to the body of the recess former by hinge web 52 (FIG. 7), releasable fastening means to fasten the top 50 in closed position and comprising tabs 54 formed on the body member and camming lugs 56 formed on the top member and adapted to snap over and interengage with tabs 54, a lip 58 extending around the front and sides of top 50, and a plurality of locator rods 60 extending upwardly from the top. The upper end of anchor receptacle 44 is provided with a rectangular aperture 62 which is complemental in shape to surface 34 at the upper end of anchor 14.

The emplacement of the anchor 14 within the tilt-up wall takes place as follows. The anchor 14 is slid onto the platform 18 through the open end of the lateral enclosure 20. The tabs 22 are yieldingly urged upwardly to accommodate the anchor base 28. The base is moved against the middle or end wall portion of enclosure 20. When the base is in this position the inner sets of tabs 22 press downwardly against the base while the outermost set of tabs 22 is disposed in blocking relation to the base. The tabs 22 thus serve to lock the base 28 to the platform 18. The support 12 with anchor 14 attached thereto is positioned in a predetermined manner on the wall form, not shown. The recess former 16, with the top 50 in open position as shown in FIG. 1, is then frictionally fitted to the anchor 14 by full insertion of the upper end of the anchor into the receptacle 44 of the recess former. The anchor end surfaces 38 are brought into engagement with the walls 48 of the former. This positioning of the upper end of the anchor may be visually checked by observing the anchor end surface 34 through the complemental aperture 62 of receptacle 44. The top 50 is then closed and the tabs 54 and lugs 56 are lockingly engaged. The slab 10 is then poured and cured.

The protruding rod elements 60 signal the location of the anchor. The thin layer of cement above the recess former is then chipped away and the top 50 is popped open. The recess former 16 is then pulled free of the wall slab. This can be readily done by gripping rib 47 with a pair of pliers and pulling.

The hoisting attachment 64 comprises a plate-like shackle 66 and a ring clutch 68, the latter comprising a spool-like annular member 70 having the spool opening closed off at the underside by an arcuate bottom wall 72, a slot 74 for anchor 14, a locking bolt 76 rotatable in the ring through approximately 180° between locking and unlocking positions, an elongated lever arm 80 attached to locking bolt 76, an aperture 82 in the end of lever arm 80, a pull rope 84 connected through aperture 82 to lever 80 and a generally central opening 86 in the ring clutch whereby the shackle 66 may have a universal pivot action relative to ring clutch 68. The ring clutch 68 is essentially identical with the one shown and described in U.S. Pat. No. 3,883,170, differing therefrom in that the lever arm 80 is made many times longer than the one in the reference and in that the aperture 82 and pull rope 84 are provided. Also, the slot 74 has a slight dovetail shape to it to allow the clutch to rotate a few degrees in each direction relative to the anchor to thus allow the ring clutch to engage the concrete surface along the recess at a point about 45° out from anchor 14.

Figure 3:
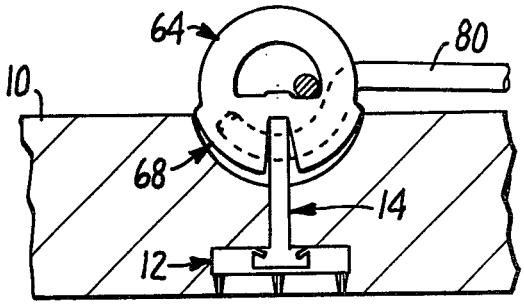
FIG. 3 is a view like that of FIG. 2 showing the hoisting attachment connected to the anchor.

FIG. 3 shows the hoisting attachment in locked relation to the wall slab 10 prior to applying a lifting force to shackle 66 through lifting cable 88. The lever arm 80 is pre-positioned to extend in the direction of the ultimate top end of the wall slab. Once the lifting action begins, the binding force applied by the anchor 14 through the locking bolt to the body of the ring clutch prevents any relative movement taking place between the lever arm 80 and the ring clutch during tilt-up movement of the slab.

Figure 4:
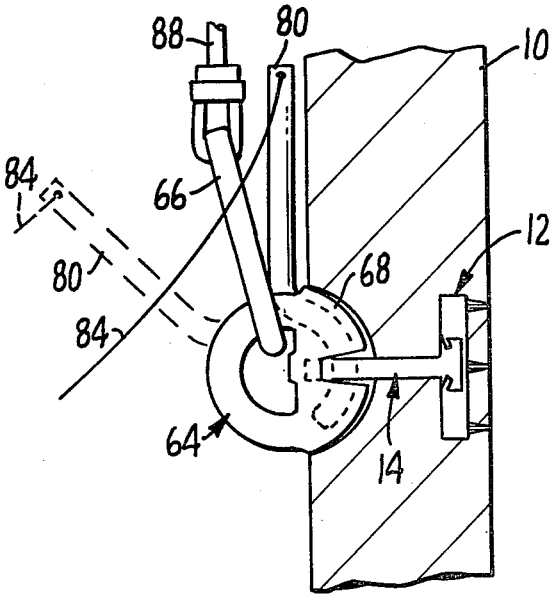
FIG. 4 is a view showing the tilt-up wall in vertical position.

FIG. 4 illustrates the slab in vertical condition at the end of the tilt-up operation. A pulling force is no longer being applied by cable 88 to shackle 66. The shackle nevertheless remains in blocking relation to the lever arm 80. Thus, premature release of the locking means, with possible damaging consequences, is prevented until such time as the hoist operator lowers the cable 88 to drop the shackle 66 to a non-blocking position relative to lever 80.

This safety feature of the release mechanism is made possible by making the lever arm 80 long enough so that its unlocking movement can be blocked by shackle 66 and the preorientation of lever 80 in the direction of the upper end of the wall slab.

Figure 11:
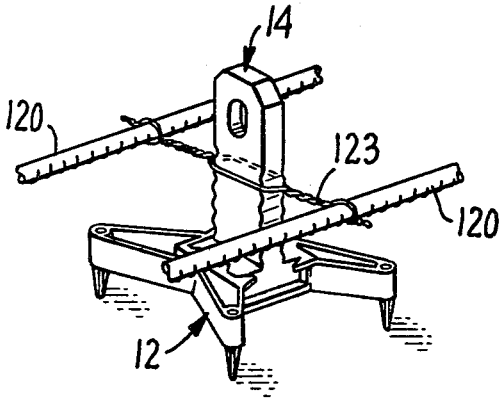
FIG. 11 is a view in perspective of an anchor, anchor support and associated concrete reinforcement means.
Figure 12:
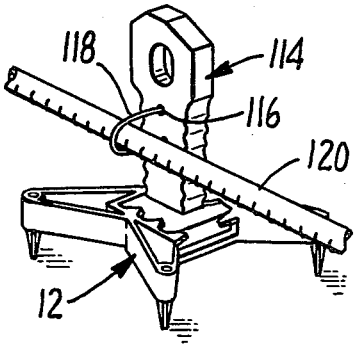
FIG. 12 is a view like that of FIG. 11 showing another manner of associating concrete reinforcement means with the anchor.

FIGS. 9–12 show a modified form of anchor 114 which is provided with means for facilitating the use of wire ties to interconnect the anchor with concrete reinforcement bar material. The anchor is provided with apertures 116 whereby a wire tie 118 (FIG. 12) may be attached to the anchor and may in turn be attached to a reinforcement bar 120. The anchor is further provided with a series of grooves 122 in its sides whereby wire ties 123 may be twist-connected to the anchor and to reinforcement bars 120, as shown in FIG. 11.

What is claimed is:

1. Apparatus for putting up a tilt-up wall section comprising a hoisting cable, a shackle connected to the cable, a ring clutch interconnecting the shackle with an anchor emplaced in the wall section, the ring clutch comprising a ring having a split therein and an arcuate locking bolt rotatable relative to said ring between a locked condition extending across the split and a released condition removed from the split, said bolt having an elongated lever arm extending generally parallel to the wall section during lifting and in the direction of the upper end thereof, a release cable attached to the distal end of the lever arm to remotely operate the lever arm by rotating it outwardly and downwardly to a predetermined degree relative to the wall section to rotate the bolt to the released condition and disconnect the ring clutch from the anchor, and hoisting cable-controlled means to selectively block or allow rotation of the lever arm to said predetermined degree, said means being operated responsive to the application of lifting force to the hoisting cable to block rotation of the lever arm upon the application of lifting force to the hoisting cable and release the arm for rotation upon slacking off of the hoisting cable.

2. The apparatus of claim 1 wherein the shackle is pivotally secured to the ring clutch for movement to and from a position blocking rotation of the lever arm, the hoisting cable-controlled means comprising the shackle which is disposed in blocking relation to the lever arm when the shackle is supported in an upwardly directed position by the hoisting cable and which is disposed in non-blocking relation to the lever arm when it moves to a downwardly directed position in response to the slacking off of said hoisting cable.

* * * * *